US005804291A

United States Patent [19]

Fraser, Jr.

[11] Patent Number: 5,804,291

[45] Date of Patent: Sep. 8, 1998

[54] CONDUCTIVE FABRIC AND PROCESS FOR MAKING SAME

[75] Inventor: Ladson L. Fraser, Jr., High Point, N.C.

[73] Assignee: Precision Fabrics Group, Inc., Greensboro, N.C.

[21] Appl. No.: 805,312

[22] Filed: Feb. 25, 1997

Related U.S. Application Data

[62] Division of Ser. No. 303,521, Sep. 9, 1994, Pat. No. 5,723, 186.

[51] Int. Cl.[6] ..... B05D 5/12

[52] U.S. Cl. ..... 428/283; 428/288; 428/290

[58] Field of Search ..... 428/224, 283, 428/288, 289, 290

[56] References Cited

U.S. PATENT DOCUMENTS

| | | | |
|---|---|---|---|
| 4,239,794 | 12/1980 | Allard | 428/219 |
| 4,435,465 | 3/1984 | Ebneth | 428/196 |
| 4,471,015 | 9/1984 | Ebneth | 428/195 |
| 4,472,474 | 9/1984 | Grosheim et al. | 428/195 |
| 4,534,886 | 8/1985 | Kraus | 252/502 |
| 4,540,624 | 9/1985 | Cannady, Jr. | 428/282 |
| 4,684,762 | 8/1987 | Gladfelter | 428/229 |
| 4,689,098 | 8/1987 | Gaughan | 428/285 |
| 4,722,860 | 2/1988 | Doljack et al. | 428/260 |
| 4,840,840 | 6/1989 | Flynn et al. | 428/283 |
| 4,865,892 | 9/1989 | Winfield | 428/283 |
| 4,869,951 | 9/1989 | McCullough, Jr. et al. | 428/229 |
| 4,889,764 | 12/1989 | Chenoweth et al. | 428/283 |
| 4,902,562 | 2/1990 | Bahia | 428/283 |
| 4,973,514 | 11/1990 | Gamble et al. | 428/297 |
| 5,021,297 | 6/1991 | Rhue et al. | 428/430 |
| 5,035,942 | 7/1991 | Nagata | 428/288 |
| 5,083,650 | 1/1992 | Seiz et al. | 427/203 |
| 5,098,771 | 3/1992 | Friend | 427/96 |
| 5,185,381 | 2/1993 | Ruffoni | 428/245 |
| 5,272,000 | 12/1993 | Chenoweth et al. | 428/283 |
| 5,284,701 | 2/1994 | Hamon | 428/246 |
| 5,298,311 | 3/1994 | Bentson et al. | 428/216 |

*Primary Examiner*—Erma Cameron

*Attorney, Agent, or Firm*—Finnegan, Henderson, Farabow, Garrett & Dunner, L.L.P.

[57] ABSTRACT

A process for forming a flexible, electrically conductive fabric by applying to a nonconductive flexible fibrous web substrate an aqueous solution comprising a conductive material and a binder, saturating the web with the aqueous solution, and drying and curing the web.

7 Claims, No Drawings

CONDUCTIVE FABRIC AND PROCESS FOR MAKING SAME

This is a division of application Ser. No. 08/303,521, filed Sep. 9, 1994 now U.S. Pat. No. 5,723,186.

BACKGROUND OF THE INVENTION

1. Field of the Invention

This invention relates to a process for applying a conductive coating to a nonconductive substrate to render the substrate electrically conductive.

2. Discussion of the Related Art

The need exists in a wide variety of industries for electrically conductive materials which can provide an object with a conductive surface or a conductive internal layer. A material capable of electrostatic dissipation, for instance, is desired for use in such disparate products as carpet backing, furniture intended for computer or electronics use, flammable chemical storage tanks, filtration media, and electrical component packaging. Thin conductive substrates also serve as diagnostic layers in composites or storage tanks, and may be used in products utilizing resistance heating, such as pipe wrapping, food warmers, or heated socks and gloves. And these materials see great use for electromagnetic interference (EMI) shielding in electronics cabinets, cable and wire shielding, and various aspects of the defense and aerospace industries.

While conductive materials have long been sought for these numerous applications, their use has been limited by cost and workability. Clearly, items such as carpet, computer furniture, and heated socks and gloves cannot utilize conductive layers when the production or incorporation costs of the layers push the price beyond reasonable limits. Thus, inexpensive, highly-workable conductive materials are strongly desired. Unfortunately, the materials currently in use are expensive to produce, difficult to work with, or both expensive and unworkable. For instance, graphite fibers and fabrics are expensive, have low flexibility, encounter dust and contamination problems, and are difficult to incorporate in structural materials. Carbonized paper has a low permeability for any desired resins, is expensive, and has low flexibility and tensile/tear strength. Metal screens and fibers are expensive, have low flexibility, are difficult to work with, and react with resins. Conductive paints and lacquers are also expensive, require surface preparation of the material to be covered in addition to post-application drying and curing steps, may be difficult to apply, and are disfavored due to overspraying, waste, and the emission of volatile organic compounds. Vacuum metallized substrates also suffer from high cost and additionally degrade when a resin is employed. Carbon-polymer composites formed of extruded carbon fibers sheathed or cored with fabrics such as nylon or PET offer good properties but are expensive to produce. Synthetic metal-salt dyed fibers similarly suffer from a high cost.

Thus, the need still exists for a low-cost, workable conductive material which can provide a conductive layer to a wide variety of products.

SUMMARY OF THE INVENTION

The present invention has been made in view of the above circumstances and comprises a process for forming a flexible, electrically conductive fabric by applying to a nonconductive flexible fibrous web substrate an aqueous solution comprising a conductive material and a binder, saturating the web with the aqueous solution, and drying and curing the resultant fabric.

The process forms a relatively inexpensive, highly workable conductive fabric which retains most of the properties of the flexible base substrate and can therefore easily be put to use in a variety of applications. The fabric generally exhibits an ASTM D-257-93 surface resistivity from 1.0 to $1.0\times10^{10}$ ohms per square, preferably from 1.0 to $1.0\times10^{6}$ ohms per square. The resistivity can be adjusted within this range by altering the ratio of substrate material to conductive material, adding further materials to the aqueous solution, nipping the substrate to a certain amount of coating add-on, or calendering or otherwise dry finishing the substrate. Further additives may be used in the conductive coating solution to control rheology, viscosity, or polymer or filler content in order to meet certain end use requirements of the fabric.

Other features and advantages of the invention will be apparent from the following description of the preferred embodiments and from the claims.

DESCRIPTION OF THE PREFERRED EMBODIMENTS

According to a preferred embodiment of the present invention, a nonconductive fibrous web substrate is dipped into an aqueous solution containing a conductive material and a binder, saturated with the solution, nipped to a predetermined wet add-on, and dried and cured to form a flexible, electrically conductive fabric. This aqueous-based treatment is applied using standard textile wet processing methods, and drying and curing are similarly performed by conventional means.

The nonconductive fibrous web substrate of the present invention can be any flexible fabric. It can be woven, nonwoven, knit, or paper, and may be natural, synthetic, or a blend. Preferably, however, the substrate is a nonwoven.

The conductive material may similarly be any material capable of providing conductivity to a nonconductive substrate. Examples include carbon black (e.g., KW3729 conductive carbon black by Heucotech Ltd.), jet black or lamp black, carbonized acrylonitrile black, dry powdered carbon (e.g., CONDUCTEX® 975 by Columbian Chemical), tin-doped antimony trioxide (e.g., ZELEC® ECP powders by Dupont Specialty Chemicals), and powdered metal dispersions. Carbon black is the preferred conductive material.

The binder used in the conductive finish can be any binder, resin, or latex capable of binding the conductive material to the substrate. Examples include butadiene acrylonitrile latex emulsions, carboxymodified acrylonitrile emulsions (e.g., HYCAR® 1571, 1572 by B.F. Goodrich), acrylonitrile butadiene styrene emulsions (e.g., HYCAR® 1577, 1580), acrylic emulsions (e.g., RHOPEX® TR407, TR934 by Rohm and Haas), polyvinyl chloride emulsions, butyl rubber emulsions, ethylene/propylene rubber emulsions, polyurethane emulsions, polyvinyl acetate emulsions (e.g., DUROSET® by National Starch), styrene-butadiene vinyl pyridine emulsions, polyvinyl alcohol emulsions, and melamine resins (e.g., AEROTEX® 3030, M-3 by Freedom Chemical). Blends of these materials, or any aqueous-based emulsions of binders, resins, or latexes, may also be used. Significantly, the ionic conductivity of the binder may secondarily contribute to the electrical conductivity of the fabric. In particular, the use of butadiene acrylonitrile latex emulsion is preferred for this reason.

Additives which exhibit ionic conductivity may also be included in the conductive coating solution to further enhance the conductivity of the fabric. These include, in general, complex anions having a high degree of dissociation, materials with high dielectric constants, polarizable materials, aromatic materials having conjugated double bonds, transition metals with full "d" orbitals (groups 10–12), and materials having sp and $sp^2$ hybridization. Specific examples of such additives are salts of sulfonic, phosphoric, or carboxylic acids wherein the hydrophobic portion contains aromatic groups (e.g., ZELEC® TY, Zelec® UN by Dupont Specialty Chemicals), amine salts, amine functional coupling agents, ion exchange resins (e.g., IONAC® PE100 by Sybron), thermosetting polyamine (e.g., ASTON® 123 by Rhone Poulenc, Polyquart H by Henkel), organic phosphate ester dispersant (e.g., DEXTROL® OC20 by Dexter Chemical), sulfonated polystyrene (e.g., VERSA® TL125 by National Starch), organosilicon (e.g., Y9567, Y9794 by Union Carbide), polyethylene glycol (e.g., Union Carbide's CARBOWAX® series), propylene glycol, and quarternary ammonium compounds (e.g., EMCOL CC9, EMCOL CC55 by Witco Chemical).

The process results in a flexible, electrically conductive fabric exhibiting high workability and an ASTM D-257-93 surface resistivity from 1.0 to $1.0\times10^{10}$ ohms per square, preferably 10 to $1.0\times10^{6}$ ohms per square. The conductivity can be adjusted within this range depending on the particular end use requirements. For instance, surface resistivities from $1.0\times10^{3}$ to $1\times10^{10}$ are appropriate for electrostatic dissipation or electrical grounding, surface resistivities less than $1.0\times10^{5}$ are generally considered electrically conductive, and surface resistivities less than $1.0\times10^{4}$ are useful for electromagnetic wave interference shielding. The adjustment in surface resistivity can be achieved, for example, by including the additives described above in the conductive coating solution, altering the ratio of substrate material to conductive material, nipping the fabric to a certain amount of coating add-on, or calendering or otherwise dry finishing the substrate. Further additives may be used in the conductive coating to control rheology, viscosity, or polymer or filler content in order to meet any particular physical requirements.

The conductive fabric of the present invention retains most of the original properties of the substrate with only minor changes. The basis weight of the fabric obviously increases, along with a decrease in permeability, both due to the addition of the conductive coating. There is also a slight increase in handle. The color will change according to the additives of the aqueous solution, and the tensile strength generally remains the same or slightly increases.

The invention will be further clarified by the following examples, which are intended to be purely exemplary.

EXAMPLE 1

The substrate used was a spunlaced hydroentangled apertured nonwoven 100% dacron polyester having a weight of 1.3 oz. per sq. yard (Dupont SONTARA® style 8010/PFGI style 700-00010). The pretreated fabric had an ASTM D-257-93 surface resistivity greater than $10^{14}$ ohms per square and is considered an electrical insulator.

The fabric was dipped and saturated in the following conductive coating solution:

| INGREDIENT | % SOLIDS | % WET OWB | % DRY OWB |
|---|---|---|---|
| Butadiene Acrylonitrile Latex Emulsion | 44% | 27.81 | 12.24 |

-continued

| INGREDIENT | % SOLIDS | % WET OWB | % DRY OWB |
|---|---|---|---|
| Conductive Carbon Black Pigment | 40% | 55.62 | 22.25 |
| Water | — | 16.57 | — |
| Total | | 100.00 | 34.49 |

The fabric was then nipped through a rubber nip roll textile pad to leave 143% wet add-on, and then framed, dried, and cured through a conventional textile lab oven for a duration of 30 seconds at a temperature of 400° F.

The resulting fabric exhibited the following properties:

| | |
|---|---|
| Basis Weight: (INDA IST 130.1-92) | 2.09 oz. per sq. yd. |
| Dry Crock Rating (AATCC 8-1989) | 4.5 |
| Grab Tensile/% Elongation (4" × 7" SPECIMEN) (INDA IST 110.1-92) | MD 33#/27%<br>XD 22#/80% |
| Thickness (INDA IST 120.1-92) | 12 mils |
| Surface Resistivity (@ 12 and 50% RH/72° F.) (ASTM D257-93) | 1200–1500 ohms per square |
| Surface Resistance (EOS/ESD S11.11) | 120–150 ohms |

In this example and the following examples, INDA/IST means The Association of the Nonwovens Industry/INDA Standard Test and EOS/ESD means Electrical Overstress/Electrostatic Discharge Association.

EXAMPLE 2

This fabric was prepared by a continuous textile finishing process consisting of the following steps:

The same substrate used in Example 1 was dipped and saturated in the following conductive coating solution:

| INGREDIENT | % SOLIDS | % WET OWB | % DRY OWB |
|---|---|---|---|
| Aqueous Ammonia (26%) | — | 0.23 | 0.06 |
| Anionic Electrolite Dispersant | 25.0 | 0.35 | 0.09 |
| Anionic Leveling Surfactant | 37.5 | 0.12 | 0.05 |
| Propylene Glycol | 100.0 | 1.84 | 1.84 |
| Conductive Carbon Black Pigment | 40.0 | 28.82 | 11.53 |
| Butadiene Acrylonitrile Latex Emulsion | 44.0 | 14.41 | 6.34 |
| Anionic Deaerator/Defoamer | 42.0 | 0.23 | 00.1 |
| Water | — | 54.00 | |
| Total | — | 100.00 | 20.01 |

OWB means on weight of the bath

The fabric was squeezed through rubber nip rolls to a wet pickup of 149% to 234% based on the weight of the substrate and then fed into a tenter frame. The tentered fabric was dryed and cured in a gas fired oven at 400° F. for 45 seconds. The cured fabric was then detentered and batched to the desired length.

The resulting fabric exhibited the following properties:

| | |
|---|---|
| Basis Weight: (INDA IST 130.1-92) | 1.65 to 1.85 oz./sq. yd. |
| Dry Crock Rating (AATCC 8-1989) | 3.5 rating |
| Grab Tensile/% Elongation (4" × 7" SPECIMEN) (INDA IST 110.1-92) | MD 37.0#/27%<br>XD 20.0#/106% |
| Thickness (INDA IST 120.1-92) | 13 mils to 15 mils |
| Surface Resistivity (@ 12 and 50% RH/72° F.) (ASTM D257-93) | 4000–4900 ohms per square |
| Surface Resistance (EOS/ESD S11.11) | 400–490 ohms |

EXAMPLE 3

This fabric was prepared by a continuous textile finishing process consisting of the following steps:

The substrate used was a PBN II #6/6 Nylon fiber spunbonded and print bonded nonwoven PFGI style 700-200010 (1.0 oz./sq. yd.). This material exhibited an ASTM D-257-93 surface resistivity of $1\times10^{13}$ to $1\times10^{14}$ ohms per square, making it nonconductive.

The substrate was dipped and saturated in the following conductive coating solution:

| INGREDIENT | % SOLIDS | % WET OWB | % DRY OWB |
|---|---|---|---|
| Aqueous Ammonia (26%) | — | 0.23 | 0.06 |
| Anionic Electrolite Dispersant | 25.0 | 0.35 | 0.09 |
| Anionic Leveling Surfactant | 37.5 | 0.12 | 0.05 |
| Propylene Glycol | 100.0 | 1.84 | 1.84 |
| Conductive Carbon Black Pigment | 40.0 | 28.82 | 11.53 |
| Butadiene Acrylonitrile Latex Emulsion | 44.0 | 14.41 | 6.34 |
| Anionic Deaerator/ Defoamer | 42.0 | 0.23 | 00.1 |
| Water | — | 54.00 | |
| Total | — | 100.00 | 20.01 |

The fabric was squeezed through rubber nip rolls to a wet pickup of 33% to 105% based on the weight of the substrate and then fed into a tenter frame. The tentered fabric was dryed and cured in a gas fired oven at 390° to 400° F. for 45 seconds. The cured fabric was detentered and batched to the desired length.

The resulting fabric exhibited the following properties:

| | |
|---|---|
| Basis Weight: (INDA IST 130.1-92) | 1.06 to 1.19 oz./sq. yd. |
| Dry Crock Rating (AATCC 8-1989) | 3.5 rating |
| Grab Tensile/% Elongation (4" × 7" SPECIMEN) (INDA IST 110.1-92) | MD 28.0#/30%<br>XD 18.0#/35% |
| Thickness (INDA IST 120.1-92) | 9 to 11 mils |
| Surface Resistivity (@ 12 and 50% RH/72° F.) (ASTM D257-93) | 22,000 to 32,000 ohms per square |
| Surface Resistance (EOS/ESD S11.11) | 2,200 to 3,200 ohms |

In addition to the method of preparing the conductive fabric described above, other methods for applying the conductive coating may be used. These include spray finishing, printing, coating with a paste or froth, or the use of frothed finish technologies or Triatex®.

The methods disclosed herein may be used to apply the conductive coating to one or both surfaces of the fibrous web substrate to attain only partial penetration of the substrate matrix. Alternatively, these methods may fully penetrate the substrate matrix with the conductive coating and thus coat the entire fibrous web.

Other embodiments of the invention will be apparent to those skilled in the art from consideration of the specification and practice of the invention disclosed herein.

What is claimed is:

1. A flexible, electrically conductive fabric, comprising:

a nonconductive flexible fibrous web substrate, and an electrically conductive coating disposed on said substrate, wherein said coating is comprised of a dispersion of carbon black and a binder, and wherein said fabric has an ASTM D-257-93 surface resistivity of 1.0 to $3.5\times10^3$ ohms/sq.

2. The fabric of claim 1, wherein said conductive coating partially penetrates said fibrous web substrate.

3. The fabric of claim 1, wherein said conductive coating completely penetrates said fibrous web substrate.

4. The fabric of claim 1, wherein said binder consists of one or more materials selected from the group consisting of butadiene acrylonitrile latex emulsions, carboxymodified acrylonitrile emulsions, acrylonitrile butadiene styrene emulsions, acrylic emulsions, polyvinyl chloride emulsions, butyl rubber emulsions, ethylene/propylene rubber emulsions, polyurethane emulsions, polyvinyl acetate emulsions, styrene-butadiene vinyl pyridine emulsions, polyvinyl alcohol emulsions, and melamine solutions.

5. The fabric of claim 1, wherein said conductive coating further comprises one or more additives selected from the group consisting of amine salts, amine functional coupling agents, ion exchange resins, thermosetting polyamines, organic phosphate esters, sulfonated polystyrene, organosilicones, polyethylene glycol, propylene glycol, and quaternary ammonium compounds.

6. A flexible, electrically conductive fabric, comprising:

a nonconductive flexible fibrous web substrate, and an electrically conductive coating disposed on said substrate, wherein said coating is comprised of a dispersion of carbon black and a butadiene acrylonitrile latex emulsion, and wherein said conductive coating completely penetrates said fibrous web substrate, and said fabric has an ASTM D-257-93 surface resistivity of 1.0 to $3.5\times10^3$ ohms/sq.

7. The fabric of claim 6, wherein said conductive coating further comprises one or more additives selected from the group consisting of amine salts, amine functional coupling agents, ion exchange resins, thermosetting polyamines, organic phosphate esters, sulfonated polystyrene, organosilicones, polyethylene glycol, propylene glycol, and quarternary ammonium compounds.

* * * * *